US011611145B2

(12) United States Patent
Kaplan

(10) Patent No.: US 11,611,145 B2
(45) Date of Patent: Mar. 21, 2023

(54) GROUND PLANE FOR ASYMMETRIC ANTENNA

(71) Applicant: Infinidome Ltd., Caesarea (IL)

(72) Inventor: Moshe Kaplan, Pardes Hana-Karkur (IL)

(73) Assignee: Infinidome Ltd., Caesarea (IL)

( * ) Notice: Subject to any disclaimer, the term of this patent is extended or adjusted under 35 U.S.C. 154(b) by 47 days.

(21) Appl. No.: 17/160,434

(22) Filed: Jan. 28, 2021

(65) Prior Publication Data

US 2022/0238996 A1 Jul. 28, 2022

(51) Int. Cl.
*H01Q 1/48* (2006.01)
*H01Q 9/06* (2006.01)

(52) U.S. Cl.
CPC ..... *H01Q 1/48* (2013.01); *H01Q 9/065* (2013.01)

(58) Field of Classification Search
CPC ..... H01Q 5/371–392; H01Q 9/40–46; H01Q 5/40–49; H01Q 9/145; H01Q 9/38; H01Q 9/32
See application file for complete search history.

(56) References Cited

U.S. PATENT DOCUMENTS 4,115,783 A 9/1978 Reggia
4,691,209 A * 9/1987 Kershaw ..... H01Q 9/38 343/729
5,173,713 A * 12/1992 Yves ..... H01Q 9/44 343/826
7,782,264 B1 8/2010 Vincent
9,350,076 B1 5/2016 Cripe
2005/0174297 A1 8/2005 Cake
2006/0214869 A1* 9/2006 Kuroda ..... H01Q 9/30 343/846
2007/0171139 A1 7/2007 King et al.
2015/0120189 A1* 4/2015 Giometti ..... H04W 72/0453 342/450
2015/0263434 A1* 9/2015 Bench ..... H01Q 5/48 343/879
2018/0133792 A1 8/2018 Mizuochi
2019/0339348 A1 11/2019 Greve

FOREIGN PATENT DOCUMENTS

WO WO 2019/021185 1/2019
WO WO 2020/031049 2/2020
WO WO 2022/162664 8/2022

OTHER PUBLICATIONS

International Search Report and the Written Opinion dated Apr. 18, 2022 From the International Searching Authority Re. Application No. PCT/IL22/50119. (10 Pages).
Poluszny "Adding-Grounding-Radials-to-Surface-Mount-Antennas", Mobile Mark, Inc., Downloaded From the Internent, 3P.,2020.

* cited by examiner

*Primary Examiner* — Ricardo I Magallanes

(57) ABSTRACT

An antenna structure includes an asymmetric antenna, an antenna feed and a ground plane connected to the asymmetric antenna via the antenna feed. The ground plane includes radials which radiate from the antenna feed. Each of the radials includes: a first conductive element having a first end and a second end, the first end being conductively connected to the antenna feed, a second conductive element conductively unconnected to the first conductive element and to the antenna feed, and a resistor connecting the second end of the first conductive element to the second conductive element.

14 Claims, 10 Drawing Sheets

GROUND PLANE FOR ASYMMETRIC ANTENNA

FIELD AND BACKGROUND OF THE INVENTION

The present invention, in some embodiments thereof, relates to an asymmetric antenna and, more particularly, but not exclusively, to a ground plane for an asymmetric antenna.

A ground plane of an antenna is a conducting surface which serves as a reflecting surface for radio waves. The radio waves that reflect off the ground plane appear to come from a mirror image of the antenna located on the other side of the ground plane. Thus a monopole antenna mounted over an ideal ground plane has a radiation pattern identical to a dipole antenna. The ground plane also reflects radio waves from the other side of the ground plane, preventing them from interfering with the functioning of the asymmetric antenna.

The ground plane is not necessarily a continuous surface. Conducting radials radiating from the antenna itself are sometimes used instead of a complete circular ground plane. Ground plane shape and size play major roles in determining the antenna's radiation characteristics.

Additional background art includes:

"Adding Grounding Radials to Surface Mount Antennas", https://www(dot)mobilemark(dot)com/download/2260/white-papers/6037/adding-grounding-radials-to-surface-mount-antennas(dot)pdf.

SUMMARY OF THE INVENTION

According to embodiments of the invention an antenna structure includes an asymmetric antenna (also denoted herein an antenna) with an antenna feed between the antenna and a ground plane. The ground plane includes radials which radiate from the antenna feed. Each radial includes two conductive elements and a resistor. The conductive elements are not connected to each other directly but rather are conductively connected together by the resistor. The conductive elements are separated from ground by a non-conductive material, so that the resistor is the only metallic connection between the two conductive elements.

The resulting ground plane provides a high level of separation between the upper and lower hemispheres, and thus enhances the performance of the antenna which is targeted for reception and/or transmission for the upper hemisphere.

According to a first aspect of some embodiments of the present invention there is provided an antenna structure which includes an asymmetric antenna, an antenna feed for inputting and outputting RF signals to the asymmetric antenna and a ground plane. The ground plane includes multiple radials radiating from the antenna feed. Each of the radials includes a first conductive element, a second conductive element and a resistor. In each radial: the first conductive element is conductively connected to the antenna feed on one end, the second conductive element is conductively unconnected to the first conductive element and to the antenna feed and the resistor connects the second end of the first conductive element to the second conductive element.

According to a second aspect of some embodiments of the present invention there is provided a method for manufacturing an antenna structure. The method includes:

providing an asymmetric antenna;

providing an antenna feed, configured for inputting and outputting RF signals to an asymmetric antenna;

providing multiples radials, each of the radials respectively including:

- a first conductive element having a first end and a second end;
- a second conductive element conductively unconnected to the first conductive element; and
- a resistor connecting the second end of the first conductive element to the second conductive element; and connecting the antenna feed between the asymmetric antenna and the first ends of the first conductive elements.

According to some embodiments of the second aspect of the invention, the method further includes connecting the radials to a non-conductive material structured to prevent a conductive connection between the radials and ground.

According to some embodiments of the first and second aspects of the invention, the asymmetric antenna is a monopole radiating element or a discone radiating element.

According to some embodiments of the first and second aspects of the invention, for each of the radials the length of the first conductive elements is within a range of 1.75 to 3.25 times the length of the second conductive elements. According to further embodiments of the first and second aspects of the invention, for each of the radials the length of the first conductive element is twice the length of the second conductive element.

According to some embodiments of the first and second aspects of the invention, each of the radials has the same total length, the total length being at least one quarter of a maximum wavelength transmittable by the asymmetric antenna.

According to some embodiments of the first and second aspects of the invention, the resistance of each of the resistors is within a range of 80% to 120% of the real part of the impedance of the asymmetric antenna multiplied by the number of radials. According to some further embodiments of the first and second aspects of the invention, the resistance of each of the resistors equals the real part of the impedance of the asymmetric antenna multiplied by a number of the radials.

According to some embodiments of the first and second aspects of the invention, the first conductive elements and the second conductive elements are conductive wires separated from ground by at least one non-conductive material.

According to some embodiments of the first and second aspects of the invention, the first conductive elements and the second conductive elements are conductive rods separated from ground by at least one non-conductive material.

According to some embodiments of the first and second aspects of the invention, the first conductive elements and the second conductive elements are conductive surfaces separated from ground by at least one non-conductive material.

According to some embodiments of the first and second aspects of the invention, the asymmetric antenna is a microstrip antenna on a printed circuit board and the conductive elements include metallic foil attached to the opposite side of the printed circuit board.

According to some embodiments of the first and second aspects of the invention, the ground plane is structured as a counterpoise suspended under the asymmetric antenna.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1A:
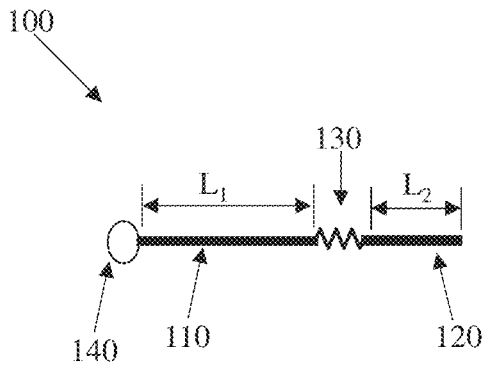
FIGS. 1A-1B are simplified diagrams of a radial according to respective embodiments of the invention.

The present invention, in some embodiments thereof, relates to an asymmetric antenna and, more particularly, but not exclusively, to a ground plane for an asymmetric antenna.

According to embodiments of the invention a ground plane for an asymmetric antenna includes radials which radiate from the antenna feed. Each radial includes two conductive elements which are conductively connected together by a resistor. The conductive elements are separated from ground by a non-conductive material, so that the resistor is the only metallic connection between the two conductive elements.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

I. Radials

Reference is now made to FIG. 1A, which is a simplified diagram of a radial according to some embodiments of the invention. Radial 100 includes conductive elements 110 and 120 which are connected together by resistor 130. One end of radial 110 is connected to antenna feed 140. In the embodiment of FIG. 1A, conductive elements 110 and 120 are substantially straight. In one example conductive elements 110 and 120 are made from a rigid material such as a metallic rod. In alternate embodiments, each conductive element is a flexible conductive material which is anchored at both ends to maintain a linear shape.

Figure 1B:
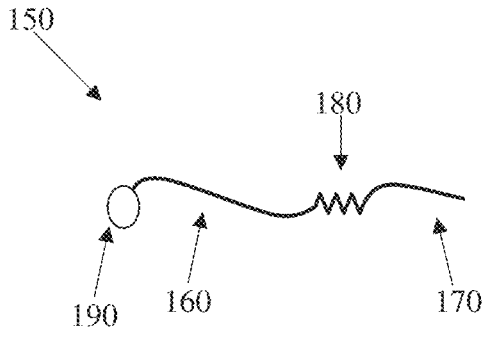

Reference is now made to FIG. 1B, which is a simplified diagram of a radial according to some alternate embodiments of the invention. Radial 150 includes conductive elements 160 and 170 which are conductively connected by resistor 180. One end of radial 160 is connected to antenna feed 190. In the embodiment of FIG. 1B, conductive elements 160 and 170 have some curvature. For example, each of the conductive elements is a flexible conductive material (such as a wire) which is anchored at both ends but does not maintain a completely linear shape.

The conductive element that is connected directly to the antenna feed (e.g., 110 of FIG. 1A) is denoted herein the first conductive element. The conductive element that is connected to the first conductive element via the resistor (e.g., 120 of FIG. 1A) is denoted herein the second conductive element.

As used herein the term "asymmetrical antenna" means an antenna having a single radiating element connected to a single antenna feed.

As used herein the term "radiating element" means an element for radiating and receiving radio frequency (RF) waves.

As used herein the term "monopole antenna" means an antenna having a rod-shaped radiating element.

As used herein the term "conductive element" means a hardware element having low electrical resistance (e.g. a metallic wire, metallic rod or flat metallic surface).

As used herein the term "resistor" means a passive circuit element that implements electrical resistance between two elements in the circuit. In embodiments of the invention, the resistor implements electrical resistance between an end of the first conductive element and an end of the second conductive element.

As used herein the term "antenna feed" means a connection point, and optionally also transmission line, for connecting the antenna with one or more RF hardware components.

As used herein the term "ground" includes both earth ground and electrical ground.

As used herein the terms "radiate" and "radiating from" mean to diverge from a central point.

As used herein the term "conductively unconnected" means that there is no direct connection between two elements by a material have low electrical resistance.

As used herein the term "conductively connected" means that there is a direct connection between two elements by a material have low electrical resistance.

Types of conductive elements include but are not limited to:

a) Conductive wires, optionally anchored to an insulator. This type of conductor shape may be particularly suitable for the high frequency (HF) RF band.

b) Conductive rods. This type of conductor shape may be particularly suitable for the very high frequency (VHF) RF band.

c) Conductive surfaces. This type of conductor shape typically results in radiating hemispheres which are perpendicular to the conductive surfaces.

Optionally, the length of the conductive element connected to the antenna feed (e.g., $L_1$ of FIG. 1A) is larger than the length of the second conductive element (e.g., $L_2$ in FIG. 1A).

Optionally, the length of the first conductive element (i.e. the conductive element connected to the antenna feed) is within a range of 1.75 to 3.25 times the length of the second conductive element. Further optionally, the length of the first conductive element about twice said respective length of said second conductive elements. Yet further optionally, the length of the first conductive element is twice the length of the second conductive element.

The conductive elements may be formed of any material suitable for radials on antenna ground planes, based on the type of antenna and its operating parameters (e.g. frequency band). Non-limiting examples of suitable materials include but are not limited to:

a) Printed lines on a printed circuit board;

b) Insulated metallic wires (e.g. insulated copper wires); and c) Metallic foil strips.

Optionally, the antenna performance is simulated to determine one or more desired radial parameters, including but not limited to:

a) Shape of the radial;

b) Resistance of the resistor between the conductive elements;

c) Relative lengths of the conductive elements;

d) Number and arrangement of the radials; and e) Material(s) forming the radials.

II. Antenna Structure

According to embodiments of the invention the antenna structure includes:

a) An asymmetric antenna connected at one end to an antenna feed;

b) An antenna feed connecting the asymmetric antenna to the ground plane; and c) A ground plane formed of multiple radials radiating from the antenna feed. Each radial includes two conductive elements which are connected by a resistor as described above.

Optionally, the antenna structure also includes a transmission line connecting the antenna feed to RF hardware, such as an RF transmitter, RF receiver, RF splitter etc. . . . .

Optionally, the radials are mounted on or connected to a non-conductive surface (e.g. dielectric material) which prevents an electrical connection between the radials and ground. In one example, the radials are anchored to insulators. In another example, the radials connected to a non-conductive surface.

Optionally, the non-conductive surface is itself mounted onto a base. For example, the ground plane may be connected to the roof of a vehicle, to protect the antenna mounted outside the car from interference by radiating elements within the car.

Types of asymmetric antennas include but are not limited to:

a) A monopole antenna; and b) A discone antenna.

Types of monopole antennas include but are not limited to:

a) Whip;

b) Rubber ducky;

c) Helical;

d) Random wire;

e) Umbrella;

f) Inverted-L;

g) T-antenna;

h) Inverted-F;

i) Mast radiator; and j) Monopole microstrip antenna.

Optionally, each of the radials has the same total length and the total length of each radial is at least one quarter of the maximum wavelength of the radio waves the antenna is designed for. The radials may thus extend for at least a quarter wavelength from the base of the antenna which as required to obtain an effective ground plane.

Optionally, the resistance of each of the resistors in the radials is within a range of 80% to 120% of the resistance of the antenna multiplied by the number of radials. Further optionally, the resistance of each of the resistors in the radials equals the resistance of the antenna multiplied by the number of radials.

As used herein the term "resistance of the asymmetric antenna" means the real part of the impedance of the asymmetric antenna (including resistive loading if present). Given an asymmetric antenna with a complex impedance of $Z=R+jX$, the resistance of the antenna is equal to R.

Non-limiting examples of the antenna structure include but are not limited to cases where:

a) The asymmetric antenna is positioned perpendicularly to a substantially flat ground plane;

b) The asymmetric antenna is positioned at an angle to a substantially flat ground plane;

c) The asymmetric antenna has radials extending downwards at an angle from the antenna feed;

d) The asymmetric antenna is mounted parallel to the ground plane, with the antenna feed connecting the radials to the asymmetric antenna;

e) The ground plane is a counterpoise suspended below the asymmetric antenna;

f) In a microstrip antenna, the conductive elements are metallic foil attached to the opposite side of the printed circuit board. Optionally the resistor is mounted on the printed circuit board.

Exemplary embodiments are described in more detail below with reference to FIGS. 2-8.

III. Exemplary Embodiments

Figure 2:
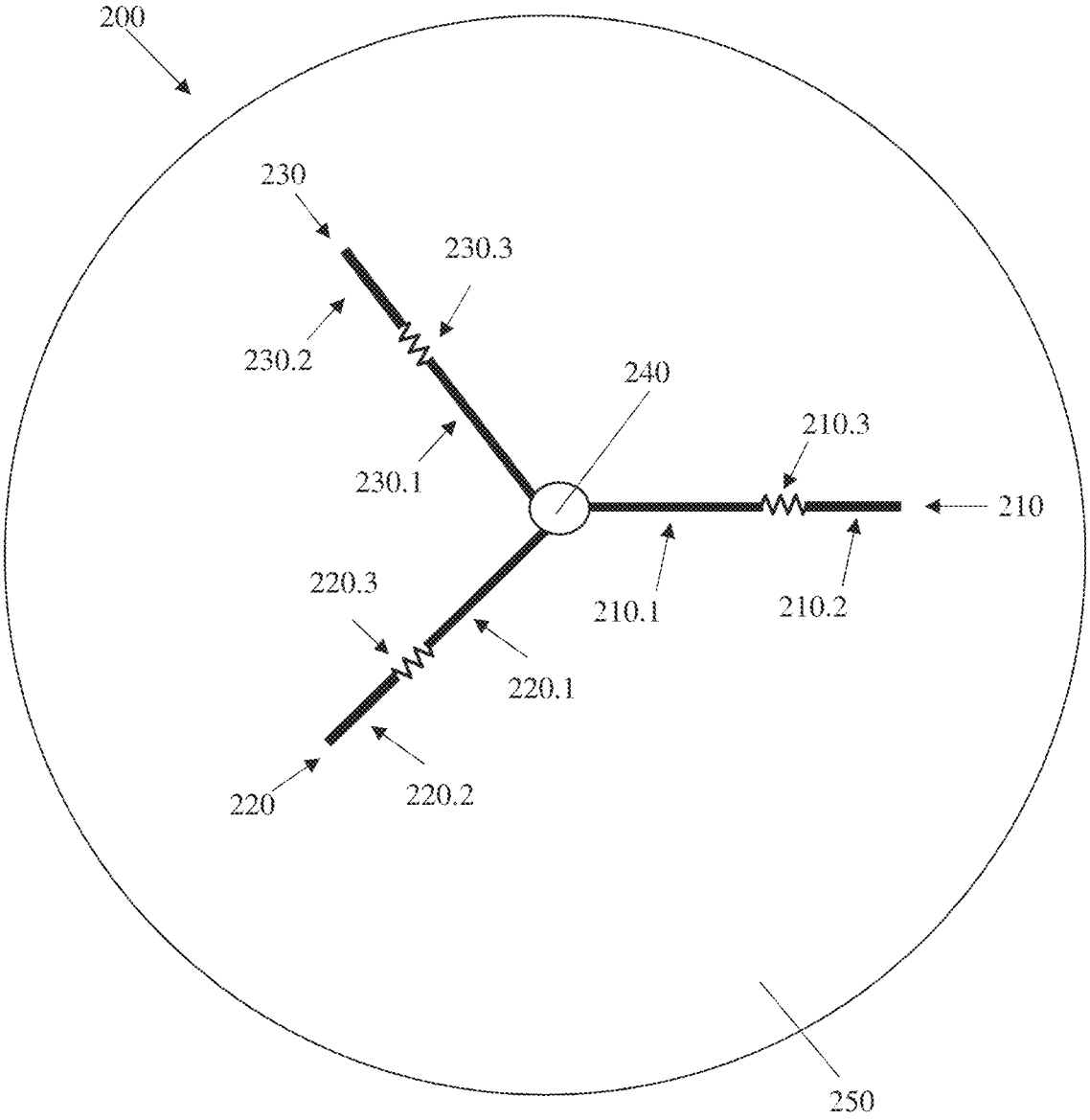
FIGS. 2 and 3 are simplified top-view diagrams of an antenna structure, according to respective exemplary embodiments of the invention.
Figure 3:
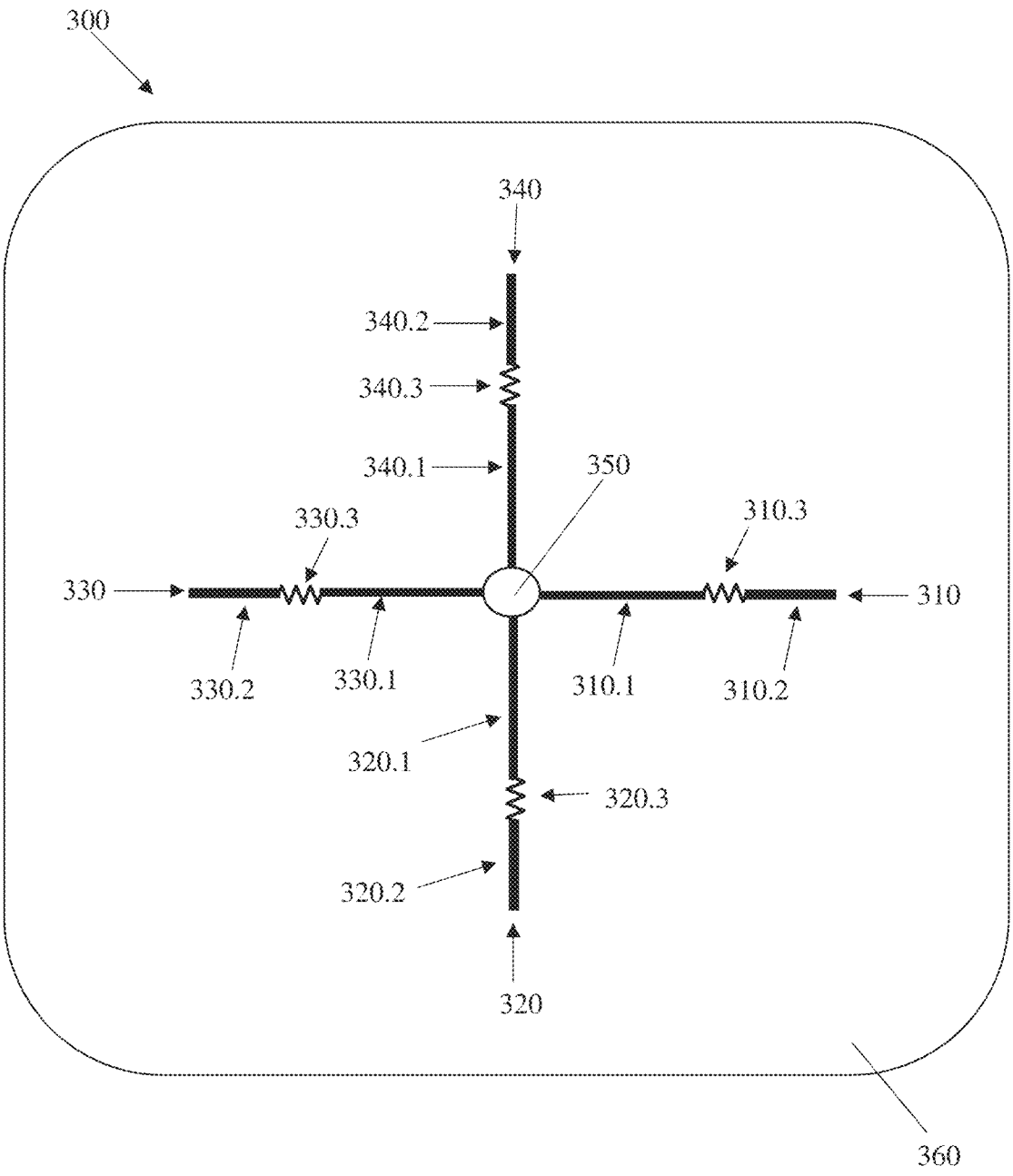

Reference is now made to FIGS. 2-3, which are simplified top-view diagrams of an antenna structure, according to respective exemplary embodiments of the invention.

FIG. 2 shows a non-limiting case in which the ground plane of antenna structure 200 includes three radials (210-230) over a non-conductive surface 250. The radials diverge outwards from antenna feed 240, which connects the ground plane to the asymmetric antenna (not shown). Each radial includes two conductive elements and a resistor connecting the conductive elements (e.g. radial 210 includes first conductive element 210.1, second conductive element 210.2 and resistor 210.3).

FIG. 3 shows a non-limiting case in which antenna structure 300 has a ground plane which includes four radials (310-340). The radials diverge outwards from antenna feed 240, which connects ground plane 250 to the asymmetric antenna (not shown). Each radial includes two conductive elements and a resistor connecting the conductive elements (e.g. radial 310 includes first conductive element 310.1, second conductive element 310.2 and resistor 310.3).

Other embodiments may include more than three radials.

Reference is now made to FIGS. 4-8, which are simplified side-view diagrams of an antenna structure, according to respective exemplary embodiments of the invention.

Figure 4:
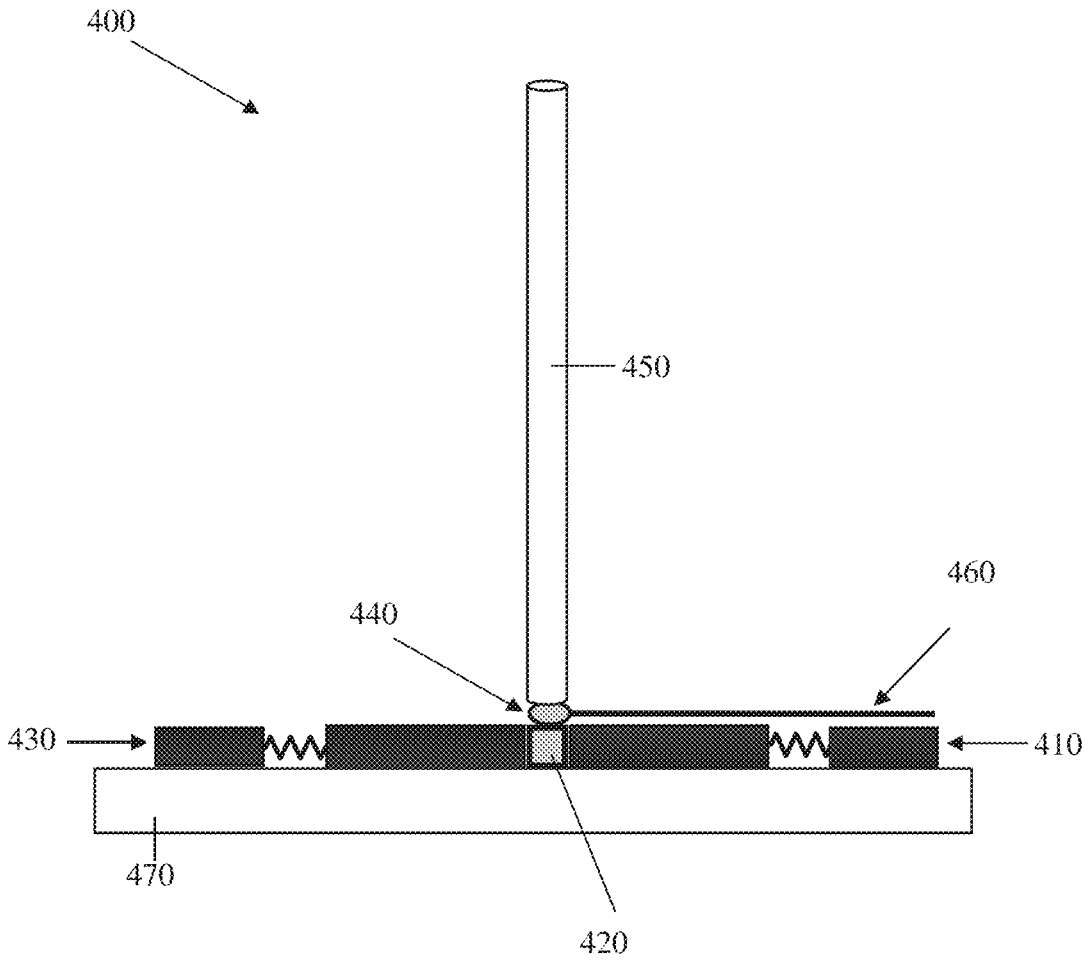
FIGS. 4, 5, 6, 7 and 8A are simplified side-view diagrams of an antenna structure, according to respective exemplary embodiments of the invention.

FIG. 4 shows an exemplary embodiment of an antenna structure having a monopole antenna 450 is connected perpendicularly to the ground plane. The ground plane includes four radials, three of which are shown in the figure (410-430) and a fourth radial which is not visible in the side view. The radials diverge outwards from antenna feed 440 that connects the radials to monopole antenna 450. Each radial includes two conductive elements and a resistor connecting the conductive elements as described above. The radials are mounted on surface 470 which is formed from a non-conductive material.

Figure 5:
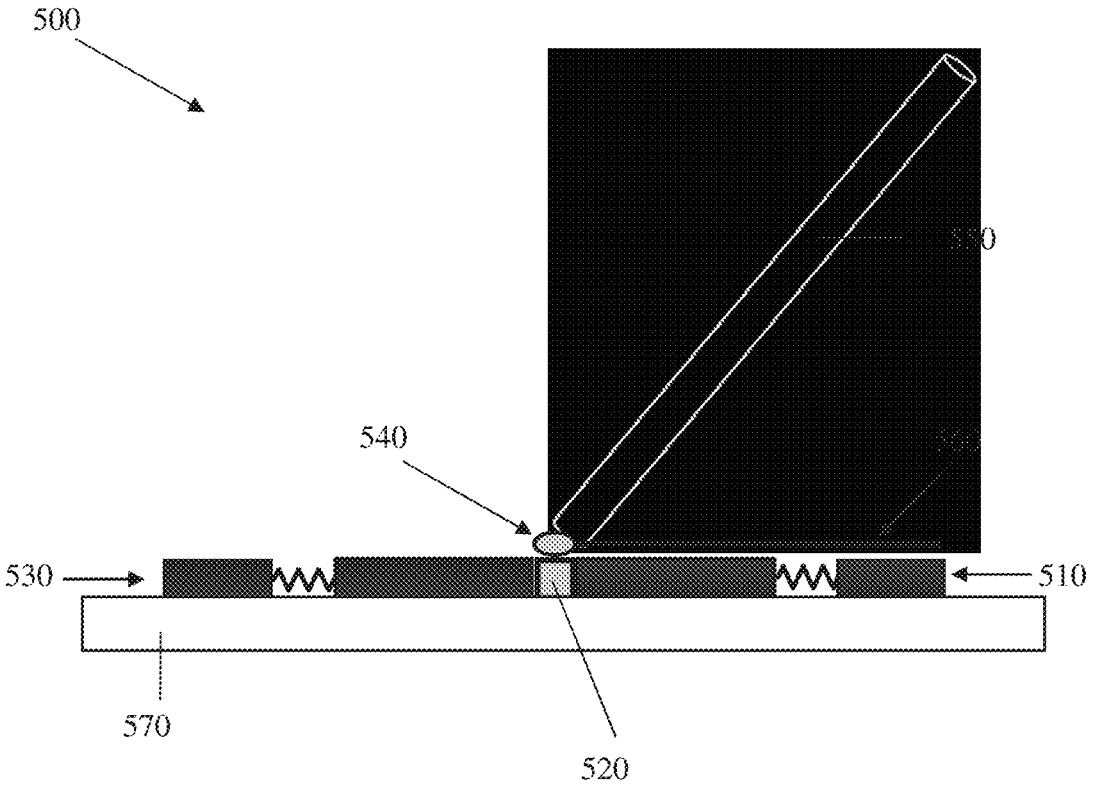

FIG. 5 shows an exemplary embodiment of an antenna structure in which monopole antenna 550 is connected at an angle to the ground plane. The ground plane includes four radials, three of which are shown in the figure (510-530) and a fourth radial which is not visible in the side view. The radials diverge outwards from antenna feed 540 that connects the radials to monopole antenna 550. Each radial includes two conductive elements and a resistor connecting the conductive elements, as described above. Feedline 560 is connected to antenna feed 540. The radials are mounted on surface 570 which is formed from a non-conductive material.

Figure 6:
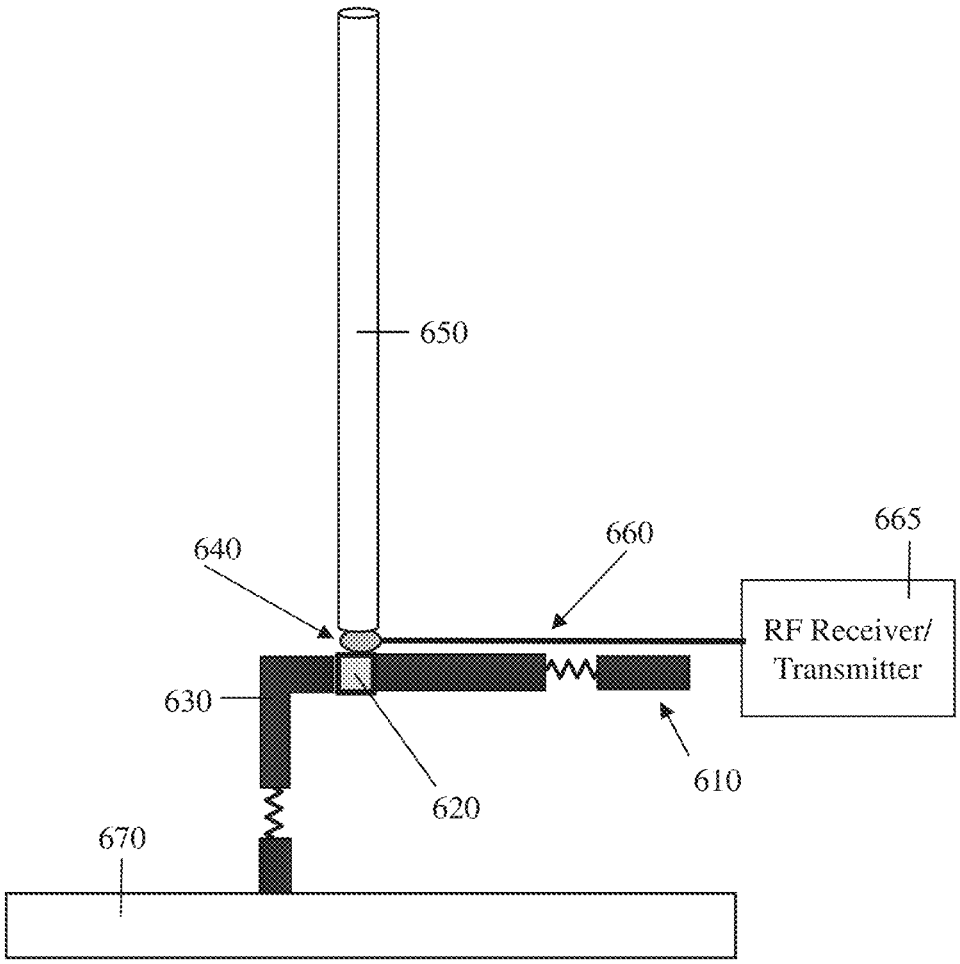

FIG. 6 shows an exemplary embodiment of an antenna structure having a monopole antenna 650 connected perpendicularly to the ground plane. The ground plane includes four radials, three of which are visible (610-630) and a fourth radial which is not visible in the side view. The radials diverge outwards from antenna feed 640 that connects the radials to monopole antenna 650. Each radial includes two conductive elements and a resistor connecting the conductive elements, as described above. Feedline 660 connects antenna feed 640 to RF receiver/transmitter 665. Radial 630 is bent at a 90° angle and is physically connected to surface 670 which is formed from a non-conductive material.

Figure 7:
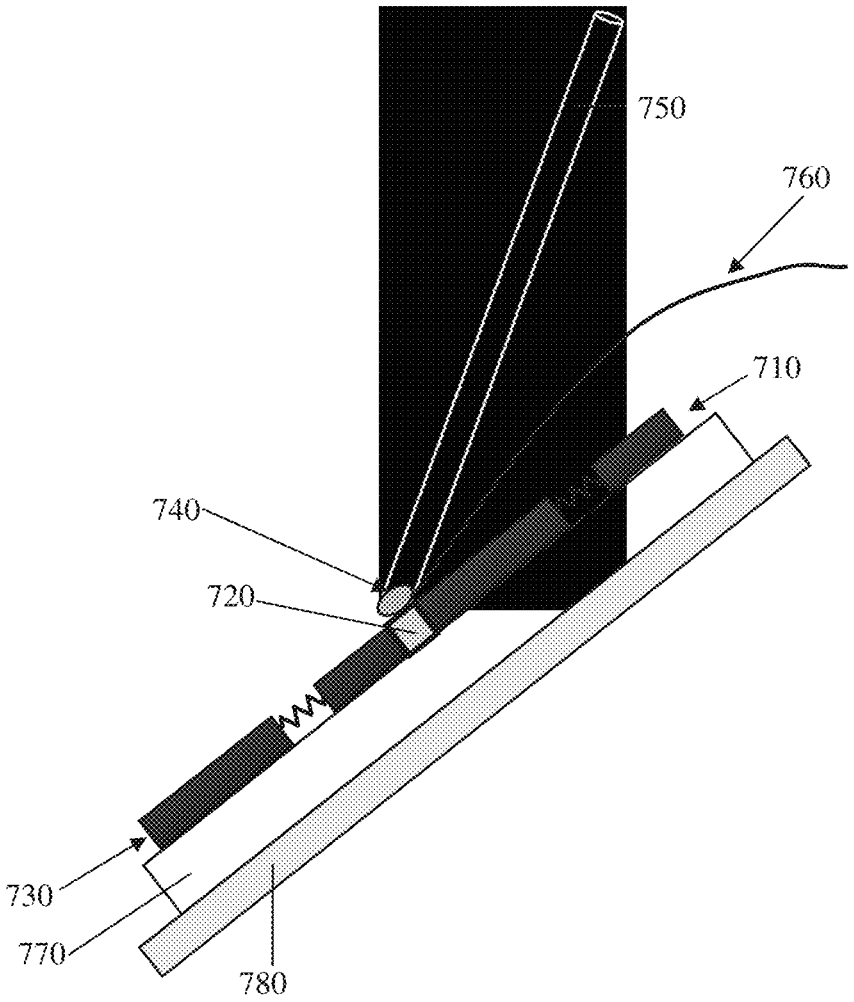

FIG. 7 shows an exemplary embodiment of an antenna structure in which monopole antenna 750 is connected at an angle to the ground plane. The ground plane includes four radials, three of which are shown in the figure (710-730) and a fourth radial which is not visible in the side view. The radials diverge outwards from antenna feed 740 which connects the radials to monopole antenna 750. Each radial includes two conductive elements and a resistor connecting the conductive elements, as described above. Feedline 760 is connected to antenna feed 740. The radials are mounted on surface 770 which is formed from a non-conductive material. Surface 770 is itself mounted on an angled, possibly conductive, base 780.

Figure 8A:
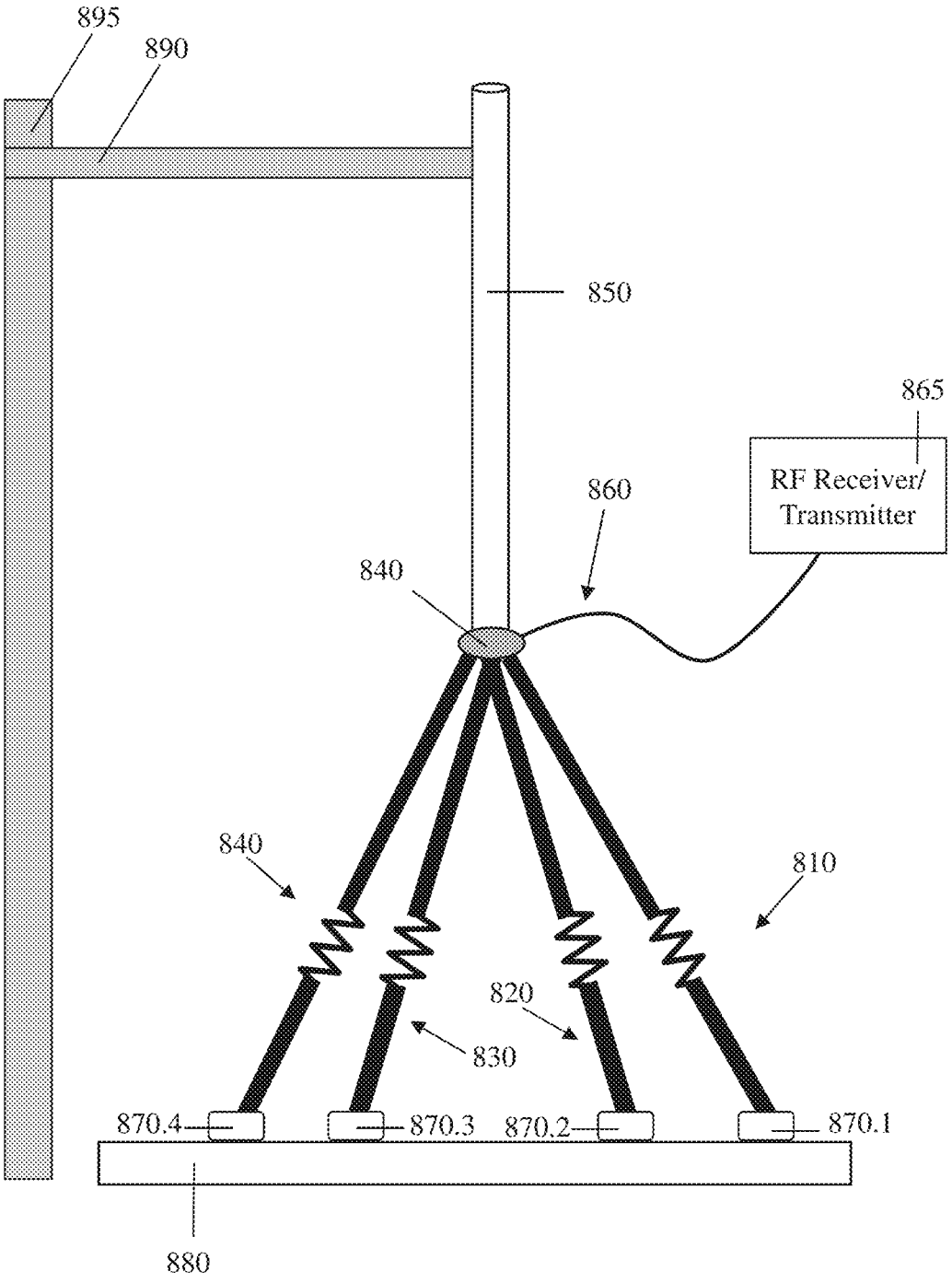

FIG. 8A shows an exemplary embodiment of an antenna structure in which monopole antenna 850 is supported by a non-conductive support 890 extending from a wall or pole 895. The ground plane includes four radials (810-840). Each radial includes two conductive elements and a resistor connecting the conductive elements, as described above. The radials extend downwards from antenna feed 840 and connect to insulators 870.1-870.4. Insulators 870.1-870.4 are connected to base 880. Feedline 860 connects antenna feed 840 to RF receiver/transmitter 865.

Figure 8B:
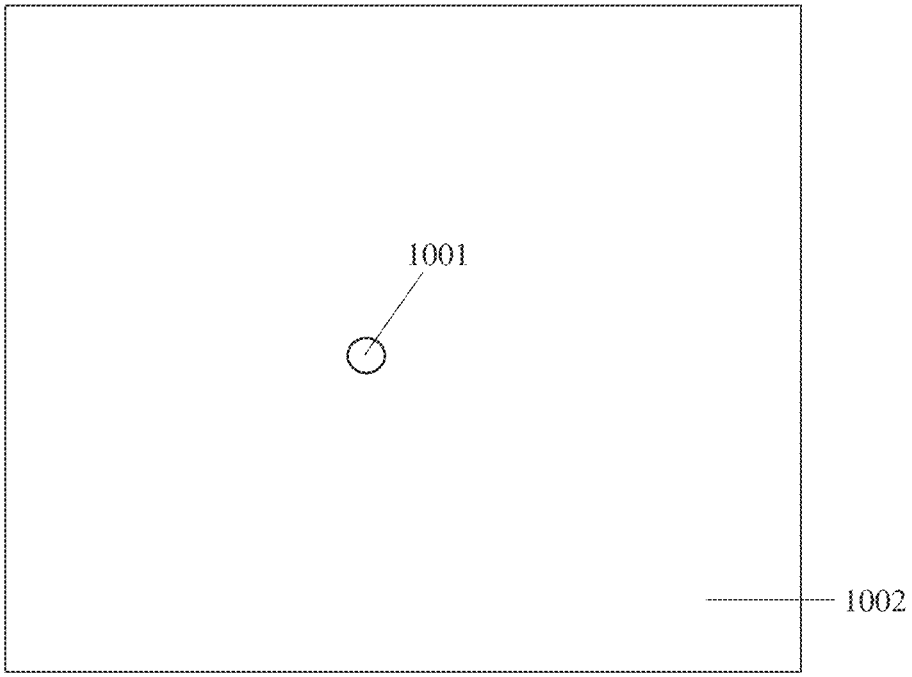
FIGS. 8B and 8C are simplified diagrams of top and bottom views of a microstrip antenna, according to embodiments of the invention.
Figure 8C:
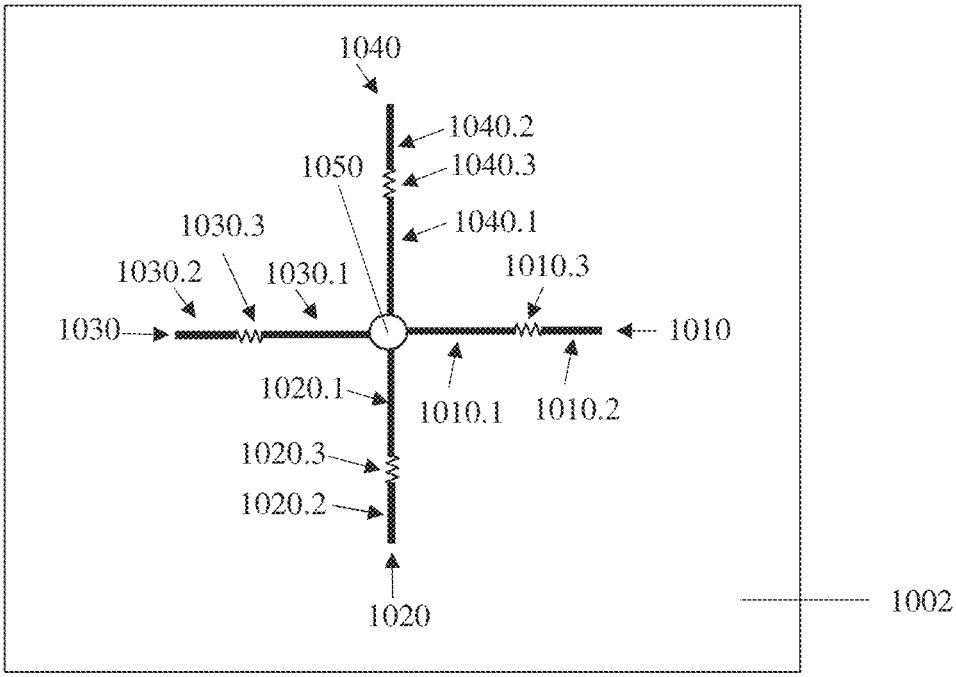

FIGS. 8B-8C are simplified top and bottom views of a microstrip antenna structure according to an exemplary embodiment of the invention. FIG. 8B shows monopole antenna 1001 on a non-conductive surface of printed circuit board 1002. FIG. 8C shows a ground plane formed metallic foil attached to the opposite side of printed circuit board 1002. The ground plane of the microstrip antenna structure includes three radials (1010-1030) on the non-conductive surface of printed circuit board 1002. The radials diverge outwards from antenna feed 1040. Each radial includes two conductive elements and a resistor connecting the conductive elements (e.g. radial 1010 includes first conductive element 1010.1, second conductive element 1010.2 and resistor 1010.3).

II. Method of Manufacturing an Antenna Structure

Figure 9:
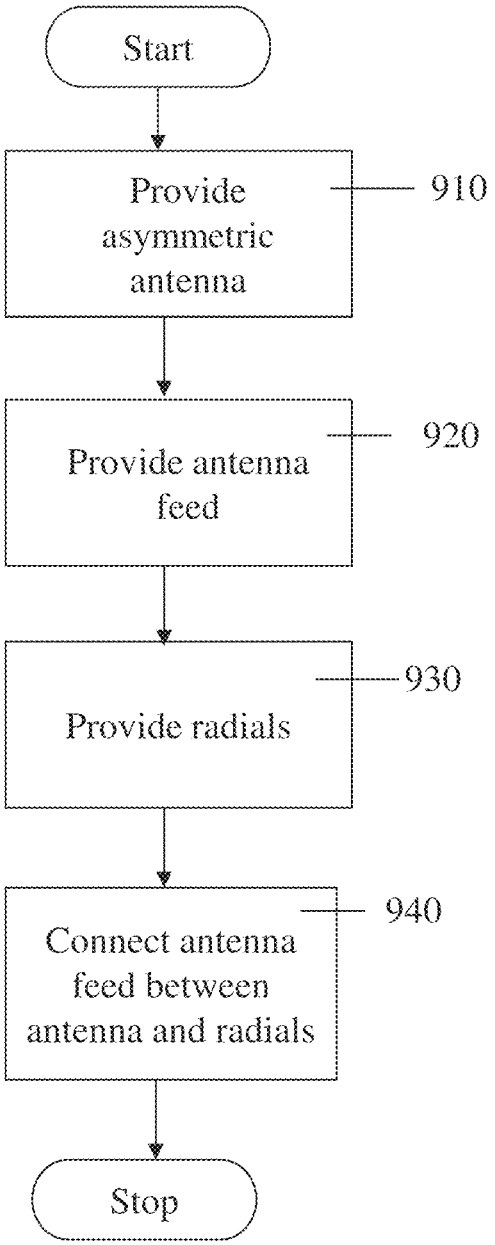
FIG. 9 is a simplified block diagram of a method for manufacturing an antenna structure, according to embodiments of the invention.

Reference is now made to FIG. 9, which is a simplified block diagram of a method for manufacturing an antenna structure, according to embodiments of the invention.

In 910 an asymmetric antenna is provided. In 920 an antenna feed configured for inputting and outputting RF signals to an asymmetric antenna is provided.

In 930 multiple radials are provided. Each of the radials includes: a first conductive element having a first end and a second end, a second conductive element conductively unconnected to the first conductive element and a resistor connecting the second end of the first conductive element to the second conductive element.

In 940, the antenna feed is connected between the asymmetric antenna and the first ends of the first conductive elements.

Optionally the radials are connected to or mounted on a non-conductive material structured to prevent a conductive connection between the radials and ground.

Optionally, the length of the first conductive element (i.e. the conductive element connected to the antenna feed) is within a range of 1.75 to 3.25 times the length of the second conductive element. Further optionally, the length of the first conductive element about twice said respective length of said second conductive elements. Yet further optionally, the length of the first conductive element is twice the length of the second conductive element.

Optionally, the resistance of each of the resistors in the radials is within a range of 80% to 120% of the resistance of the antenna multiplied by the number of radials. Further optionally, the resistance of each of the resistors in the radials equals the resistance of the antenna multiplied by the number of radials.

Optionally, the antenna is manufactured according to a design specification. Optionally, the design specifications are based on simulations of antenna performance under different conditions in order to determine one or more desired radial parameters, including but not limited to:

a) Shape of the radial;

b) Resistance of the resistor between the conductive elements;

c) Relative lengths of the conductive elements;

d) Number and arrangement of the radials;

e) Type and structure of the radiating element;

f) Materials used for the antenna elements; and g) Mechanical connections between the antenna elements.

Shapes of radials include but are not limited to:

a) Conductive wires;

b) Conductive rods; and c) Conductive surfaces.

It is expected that during the life of a patent maturing from this application many relevant asymmetric antennas, monopole antennas, antenna feeds, structures and conductive materials for ground plane radials and non-conductive materials will be developed and the scope of the term asymmetric antenna, monopole antenna, antenna feed, radial and non-conductive material is intended to include all such new technologies a priori.

As used herein the term "about" refers to ±10%.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

It is the intent of the applicant(s) that all publications, patents and patent applications referred to in this specification are to be incorporated in their entirety by reference into the specification, as if each individual publication, patent or patent application was specifically and individually noted when referenced that it is to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed is:

1. An antenna structure comprising:

an asymmetric antenna;

an antenna feed associated with said asymmetric antenna, configured for inputting and outputting RF signals to said asymmetric antenna; and a ground plane associated with said asymmetric antenna and said antenna feed, said ground plane comprising a plurality of radials radiating from said antenna feed, each of said radials respectively comprising:

a first conductive element having a first end and a second end, said first end being conductively connected to said antenna feed;

a second conductive element conductively unconnected to said first conductive element and to said antenna feed; and a resistor connecting said second end of said first conductive element to said second conductive element wherein a resistance of each of said resistors is within a range of 80% to 120% of a real part of an impedance of said asymmetric antenna multiplied by a number of said radials.

2. An antenna structure according to claim 1, wherein said asymmetric antenna comprises one of a monopole radiating element and a discone radiating element.

3. An antenna structure according to claim 1, wherein, for each of said radials, a respective length of said first conductive elements is within a range of 1.75 to 3.25 times a length of said second conductive elements.

4. An antenna structure according to claim 3, wherein said respective length of said first conductive elements is twice said respective length of said second conductive elements.

5. An antenna structure according to claim 4, wherein each of said radials has the same total length, said total length being at least one quarter of a maximum wavelength transmittable by said asymmetric antenna.

6. An antenna structure according to claim 1, wherein a resistance of each of said resistors equals a real part of an impedance of said asymmetric antenna multiplied by a number of said radials.

7. An antenna structure according to claim 1, wherein said first conductive elements and said second conductive elements comprise conductive wires separated from ground by at least one non-conductive material.

8. An antenna structure according to claim 1, wherein said first conductive elements and said second conductive elements comprise conductive rods separated from ground by at least one non-conductive material.

9. An antenna structure according to claim 1, wherein said first conductive elements and said second conductive elements comprise conductive surfaces separated from ground by at least one non-conductive material.

10. An antenna structure according to claim 1, wherein said asymmetric antenna comprises a microstrip antenna on a printed circuit board and said conductive elements comprise metallic foil attached to the opposite side of said printed circuit board.

11. An antenna structure according to claim 1, wherein said ground plane is structured as a counterpoise suspended under said asymmetric antenna.

12. A method for manufacturing an antenna structure comprising:

providing an asymmetric antenna;

providing an antenna feed, configured for inputting and outputting RF signals to an asymmetric antenna;

providing a plurality of radials, each of said radials respectively comprising:

a first conductive element having a first end and a second end;

a second conductive element conductively unconnected to said first conductive element; and a resistor connecting said second end of said first conductive element to said second conductive element; and connecting said antenna feed between said asymmetric antenna and said first ends of said first conductive elements, wherein a resistance of each of said resistors is within a range of 80% to 120% of a real part of an impedance of said asymmetric antenna multiplied by a number of said radials.

13. A method according to claim 12, further comprising connecting said radials to a non-conductive material structured to prevent a conductive connection between said radials and ground.

14. A method according to claim 12, wherein, for each of said radials, a respective length of said first conductive elements is within a range of 1.75 to 3.25 times a length of said second conductive elements.

* * * * *